United States Patent [19]

Meenan et al.

[11] 3,933,294

[45] Jan. 20, 1976

[54] FILE FOLDER WITH A RIGID SPINE

[76] Inventors: Vincent D. Meenan, 25 Millbrook Drive, Middletown, N.J. 07748; Thomas P. Meenan, 3309 164th St., Flushing, L. I., N.Y. 11358

[22] Filed: Aug. 29, 1974

[21] Appl. No.: 501,546

[52] U.S. Cl. ..... 229/1.5 R; 40/359; 229/72

[51] Int. Cl.[2] ..... G65D 27/00

[58] Field of Search ..... 229/1.5 R, DIG. 3, 68 R, 229/72; 40/359; 206/312

[56] References Cited

UNITED STATES PATENTS

| | | | |
|---|---|---|---|
| 1,596,311 | 8/1926 | Schaffert | 40/359 |
| 1,743,305 | 1/1930 | Banks | 229/1.5 R |
| 1,774,215 | 8/1930 | Weinthrop | 229/68 R |
| 2,756,874 | 7/1956 | Erickson et al. | 229/72 |
| 3,620,440 | 11/1971 | Humphrey | 229/72 |

FOREIGN PATENTS OR APPLICATIONS

| | | | |
|---|---|---|---|
| 232,882 | 4/1925 | United Kingdom | 40/359 |
| 1,410,189 | 7/1965 | France | 40/359 |

*Primary Examiner*—William Price
*Assistant Examiner*—Bruce H. Bernstein

[57] ABSTRACT

A one-piece file folder for use in vertical, lateral, rotary and similar files having an expandable pocket on the inside for containing papers and the like and a substantially rigid spine at a closed end, that is, folded edge, of the folder for indexing, or otherwise identifying said papers within the folder. The file folders herein are to be filed with their visible rigid spines vertically or horizontally, in the files.

3 Claims, 8 Drawing Figures

Fig. 1.
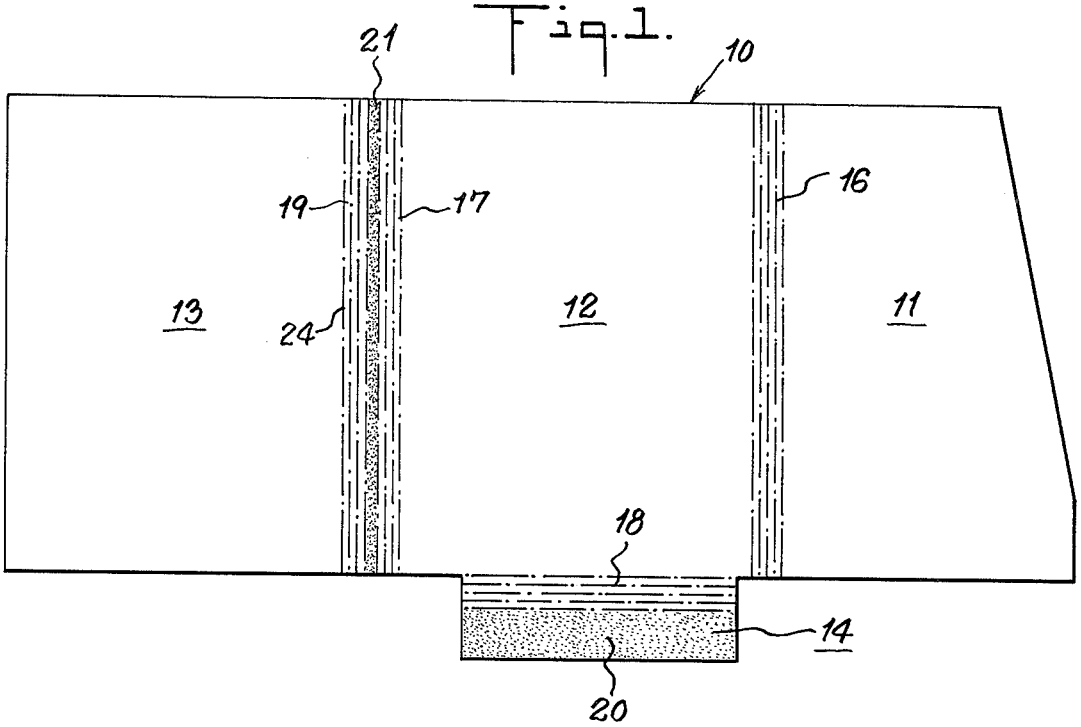
Fig. 2.
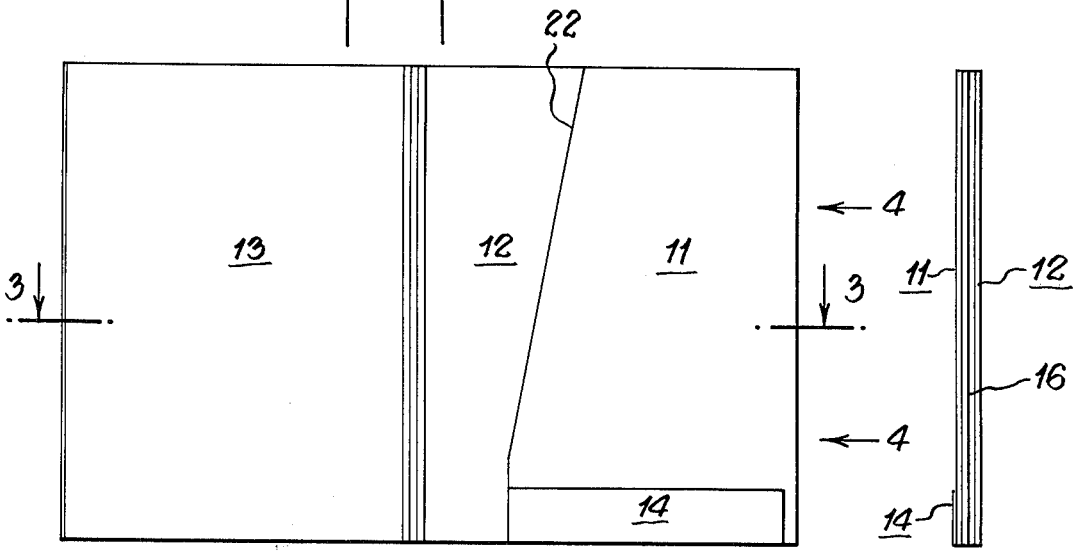
Fig. 4.
Fig. 3.
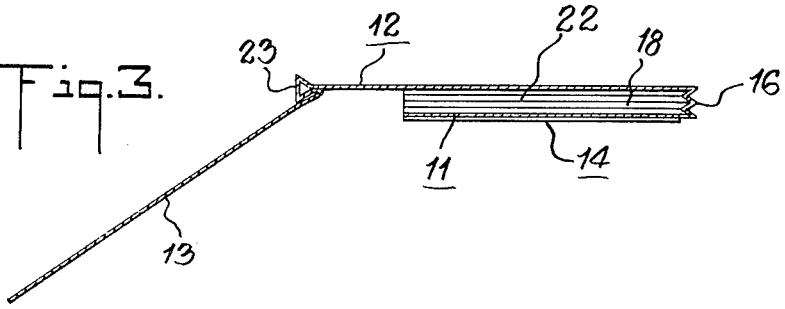

Fig. 5.
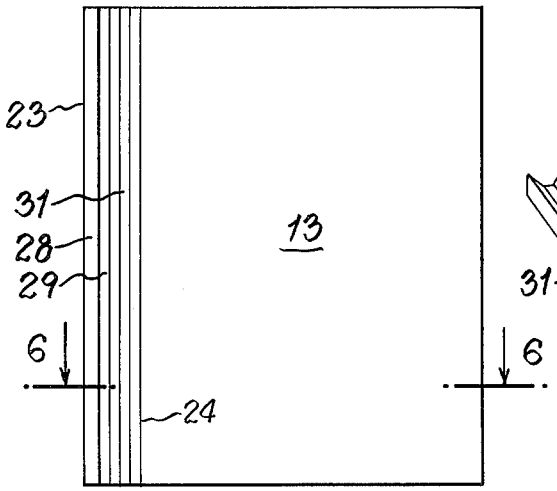
Fig. 7.
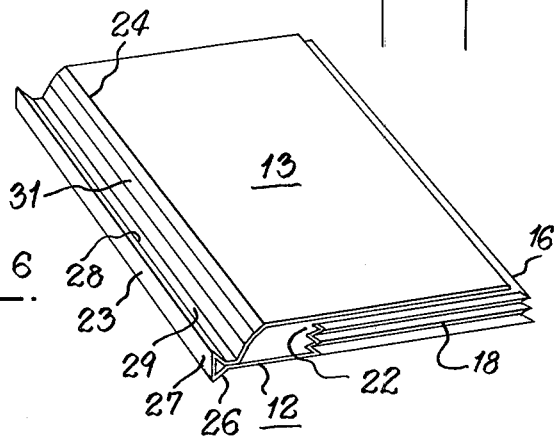
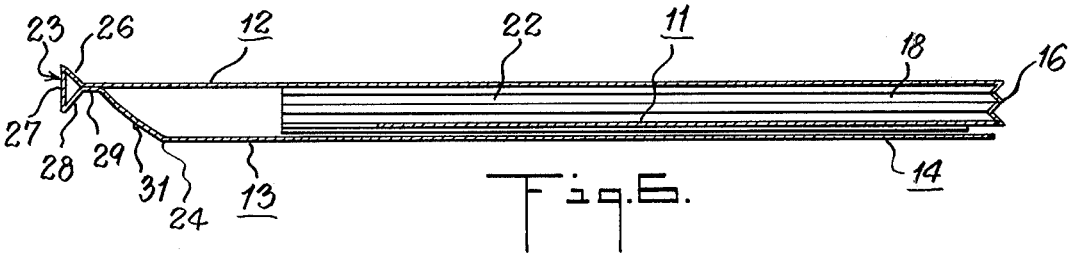
Fig. 6.
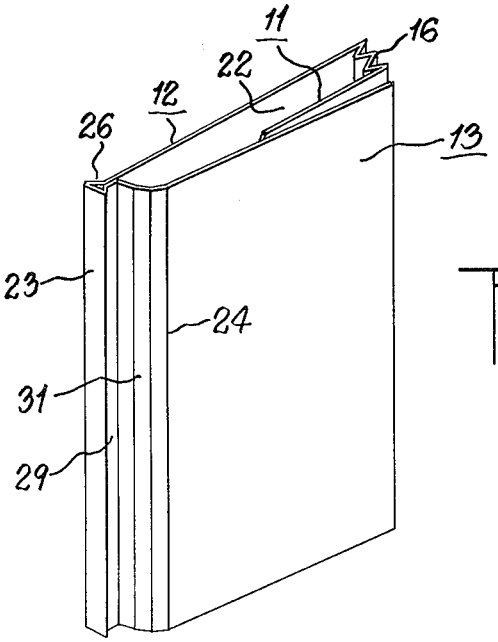
Fig. 8.

FILE FOLDER WITH A RIGID SPINE

BACKGROUND OF THE INVENTION

1. Field of the Invention

The present invention relates to file folders and, more particularly, to improved one-piece folders arranged vertically or horizontally with rigid spines for more ready identification and retrieval thereof.

2. Description of the Prior Art

Conventional file folders presently in use are of a one-piece material, folded so as to form a front leaf and a back leaf with the back leaf about three fourths inch higher than the front leaf. Such folders are open on three sides, top, left and right and are usually filed with the closed, or spine, side resting on the bottom of a file drawer. With the top and two sides of the folder open, a V pocket is formed between the front and back leaves for filing papers therein; while identification or indexing of the papers within the pocket is placed along the extended portion of the back leaf. This extended portion is usually die-cut so as to provide an off-setting tab for ready identification. Examples of such folders are shown in U.S. Pat. Nos. 1,115,216 of Oct. 27, 1914, 1,308,471 of July 1, 1919, 2,062,436 of Dec. 1, 1936 and 3,459,361 of Aug. 5, 1969.

SUMMARY OF THE INVENTION

Accordingly, an object of the present invention is to provide an improved file folder adaptable for having its folded spine side filed vertically or horizontally with its spine facing outward for ready identification of the contents therein.

Another object is to provide an improved file folder having a rigid spine that can be indexed to assure a more efficient and easier method for locating a folder and a more positive method for returning the removed folder to its proper place in the file.

A further object is to accomplish the foregoing objects in a simple, practical and economical manner.

Other and further objects will be obvious upon an understanding of the illustrative embodiment about to be described, or will be indicated in the appended claims, and various advantages not referred to herein will occur to one skilled in the art upon employment of the invention in practice.

In accordance with the present invention, the foregoing objects are generally accomplished by providing a file folder which can be set in a file so as to enable the closed or spine side of the folder to face out, or up, depending on the file in use. Accordingly, the essence of this invention resides in producing a rigid spine that can be indexed so as to provide a more efficient and easier method for locating a folder and a more positive method to insure its being returned to its proper place in the file.

In construction, a single sheet of oak tag stock or similar material has an extended area thereof die-cut, folded in and glued or otherwise fastened in such a manner as to form an expandable pocket. The overall sheet is folded in half so as to place the pocket on the inside and a line is formed at the folded portion. At the fold line a triangular rigid spine is formed by joining the inside portion of the two sides resulting from the fold with glue, staple or similar means. The joined portion is of course determined by the width of the spine desired.

For filing purposes, whether standing upright on its short side with the spine facing out, as would be used in most rotary or lateral files, or whether placed in a vertical file with the spine facing up, it is to be noted that the spine will remain rigid, thereby eliminating "hidden indexing." This rigid spine improvement will also facilitate removal of the folder from the file.

BRIEF DESCRIPTION OF THE DRAWINGS

A preferred embodiment of the invention has been chosen for purposes of illustration and description and is shown in the accompanying drawings, forming a part of the specification, wherein:

FIG. 1 is a top plan view of blank cut material for a folder showing score lines in accordance with the present invention.

FIG. 2 is a top plan view showing the folder of FIG. 1 after it has been folded along several scoring lines to form an expandable pocket.

FIG. 3 is a sectional view taken along line 3—3 on FIG. 2.

FIG. 4 is an end elevational view of FIG. 2 taken in the direction of the arrows 4—4.

FIG. 5 is a front elevational view of the folder in a closed condition standing on its short side.

FIG. 6 is an enlarged view taken along line 6—6 on FIG. 5.

FIG. 7 is a perspective view showing the folder on its side in a horizontal position.

FIG. 8 is a perspective view showing the folder in an upright position.

DESCRIPTION OF PREFERRED EMBODIMENT

Referring now to FIGS. 1 to 8 of the drawings in detail, there is shown in FIG. 1 a flat sheet 10 of suitable folder material, such as oak tag stock or 1 ply Manila tag, of a size to produce a folder having dimensions, say of about 9 ¼ inches × 11 ¾ inches with a spine width of about 3/16 inches. As viewed in FIG. 1, the sheet 10 is subdivided into four portions 11, 12, 13 and 14 by score lines 16, 17, 18 and 19, portions 11 and 14 to be used in forming a pocket and portions 12 and 13 for the back and front leaves, respectively, of the folder, as will appear hereinafter. Glue portion 20 is for adhesively securing portions 11 and 14 together and glue portion 21 is for adhesively securing contiguous portions 12 and 13 together.

In assembling the folder, after the sheet 10 has been diecut, the first step is to score the lines 16, 17, 18 and 19 so as to provide accordion type expansion zones and then apply the glue or suitable adhesive to portions 20 and 21, after which portion 11 is folded along the score lines 16 to the left, as viewed in FIG. 1, and portion 14 is folded upwardly along the score lines 18 to overlap portion 11 and be adhesively secured thereto. Thus expandable pocket 22 is formed by the joining of portions 11 and 14, as is readily evident in FIGS. 2, 3, 6, 7 and 8.

Now that the pocket 22 has been formed, the next step is to prepare a spine 23 for the folder. This is done, see FIGS. 1 and 3, by applying glue to portion 21, folding the sheet 10 along the four lines 17, after which the four corners produced from lines 17 are formed into a triangular spine 23 in cross section, as seen particularly in FIGS. 3, 6, 7 and 8. The sheet 10 is then folded along the right edge of glue portion 21, so that portion 13 is adhesively secured to portion 12 to thereby provide a reinforced spine 23, including sides 26, 27 and 28 (FIG. 6), forming the triangle and reinforcing glued leg 29. The portion 13 forms an expandable surface 31, which is bounded by line 24 and glued leg 29, so that portion 13 now is placed in overlap relationship with respect to the pocket 22, as seen in FIGS. 6, 7 and 8, to complete the assembly.

From the foregoing description, it will be seen that the present invention provides an improved folder whose rigid spine enables the folder to remain in an upstanding position much longer than those of the prior art. Further, information written horizontally on the spine can be read without difficulty. The spine can be color coded and additionally strengthened with a plastic insert. Also, papers can be deposited in the pocket of the folder, whether resting vertically or horizontally, without loss or mutilation.

As various changes may be made in the form, construction and arrangement of the parts herein, without departing from the spirit and scope of the invention and without sacrificing any of its advantages, it is to be understood that all matters are to be interpreted as illustrative and not in any limiting sense.

What is claimed is:

1. A file folder formed from a single, flat sheet having a front leaf and a back leaf and a pocket in the back leaf, characterized by means at a juncture of the front and back leaves for forming a rigid index spine along said juncture, said means including a flat surface along said juncture forming said spine for placement of indexing information on said flat surface, said index spine being triangular in cross section and in which said flat surface faces outward, and said means also including a short portion of said front leaf along said juncture adhesively secured thereto to provide a reinforcing leg for said rigid index spine.

2. A file folder formed from a single, flat sheet having a front leaf and a back leaf and a pocket in the back leaf, characterized by means at a juncture of the front and back leaves for forming a rigid index spine along said juncture, said means including a flat surface along said juncture forming said spine for placement of indexing information on said flat surface, said flat surface extending from one end to the other end of said juncture, said index spine being triangular in cross section and in which said flat surface faces outward, said means further including a plurality of score lines at said juncture, said score lines being formed into a triangular spine in cross section, said means also including a short portion of said front leaf along said juncture adhesively secured thereto to provide a reinforcing leg for said rigid index spine.

3. A file folder according to claim 2, wherein said means include score lines adjacent said adhesively secured short portion on said front leaf for providing an expandable surface to said front leaf in accordance with material placed within said pocket.

* * * * *